US009061748B2

(12) United States Patent
Metcalf

(10) Patent No.: US 9,061,748 B2
(45) Date of Patent: Jun. 23, 2015

(54) FOLDING LEG AND LATCH STRUCTURE FOR WAKEBOARD TOWER

(71) Applicant: Xtreme Marine Corporation, Maryville, TN (US)

(72) Inventor: Robert Blaine Metcalf, Loudon, TN (US)

(73) Assignee: Xtreme Marine Corporation, Maryville, TN (US)

( * ) Notice: Subject to any disclaimer, the term of this patent is extended or adjusted under 35 U.S.C. 154(b) by 5 days.

(21) Appl. No.: 14/068,109

(22) Filed: Oct. 31, 2013

(65) Prior Publication Data

US 2015/0114279 A1 Apr. 30, 2015

(51) Int. Cl.
*B63B 17/02* (2006.01)
*B63B 35/81* (2006.01)

(52) U.S. Cl.
CPC ..... *B63B 35/816* (2013.01)

(58) Field of Classification Search
CPC ..... B63B 17/02; B63B 35/1816
USPC ..... 114/343, 361
See application file for complete search history.

(56) References Cited

U.S. PATENT DOCUMENTS

| | | | | |
|---|---|---|---|---|
| 4,114,718 | A * | 9/1978 | Lipshield | 180/89.14 |
| 8,196,542 | B2 * | 6/2012 | Oswell et al. | 114/364 |
| 2007/0283873 | A1 * | 12/2007 | Jackson | 114/343 |

* cited by examiner

*Primary Examiner* — Stephen Avila
(74) *Attorney, Agent, or Firm* — Luedeka Neely Group, P.C.

(57) ABSTRACT

A wakeboard tower having a foldable tower leg having a spring loaded latch assembly mounted to the first section of the leg and a lock pin mounted to the second section of the leg, with the spring loaded latch assembly including a handle rotatably mounted to an exterior portion of the first section of the leg and having a rod including a protruding cam surface located on the rod and a spring operable to bias the cam surface in a direction away from the handle.

6 Claims, 13 Drawing Sheets

FOLDING LEG AND LATCH STRUCTURE FOR WAKEBOARD TOWER

FIELD

The present disclosure relates to wakeboard towers for boats. More particularly, the disclosure relates to a folding leg and latch structure for a wakeboard tower.

BACKGROUND

The sport of wakeboarding is very similar to the sports of waterskiing, kneeboarding, and tubing. A wakeboarder or person riding a wakeboard is towed behind the boat by a rope. Typically, waterskiing, kneeboarding, and tubing utilize a motorboat having a rope secured to a stern mount on either or both sides of the motor of the boat. However, in the sport of wakeboarding, a boat having an elevated tower is used and the rope is typically attached to a mount connected to a tower cross member.

The mount on the tower provides a much higher connection point for the tow rope and provides vertical component force on the tow rope held by a wakeboarder that allow the wakeboarder to more easily perform aerial stunts and maneuvers. That is, the wakeboarding experience is improved by use of a tow point that is elevated as compared to the lower elevation of tow points used for waterskiing. Typically, due to the forces exerted on the tower during towing of a person for wakeboarding and the like, rigid, unitary tower structures are utilized.

However, the presence of an elevated tower structure is undesirable when towing and storing of the boat. Accordingly, what is desired is a tower structure that can be folded to an unelevated configuration, but having a locking structure that is able to maintain the tower in an elevated configuration for use. Various folding tower structures are known, but improvement is desired in the mechanisms for locking the tower in an elevated configuration while permitting folding of the tower as may be desired for transport or storage of the boat with the tower.

The disclosure advantageously provides easy to use folding leg and latch structures. The structures enable convenient locking and unlocking of the legs without the use of tools and without removable pins and the like that are often difficult to remove and are often lost.

SUMMARY

The disclosure relates to a foldable boat tower mountable to a boat.

In one embodiment, the tower includes an arch foldable between an elevated position and a lowered position, the arch having a crosspiece and a leg depending from the crosspiece. The leg has a first and second sections, one of the first and the second sections being pivotally positionable relative to the other between an elevated position and a towered position.

A spring loaded latch assembly is mounted to the first section of the leg and a lock pin mounted to the second section of the leg. The spring loaded latch assembly includes a handle rotatably mounted to an exterior portion of the first section of the leg and having a rod including a protruding cam surface located on the rod and a spring operable to bias the cam surface in a direction away from the handle. The lock pin includes a receiving surface configured to fittingly receive the protruding cam surface.

The handle may be rotated in a first direction to a first stop position to position the cam surface in a first position having the cam surface of the latch assembly engaged with the receiving surface of the lock pin and the spring supplies a force to maintain the cam surface within the receiving surface and thereby lock the first and second leg sections together to provide the elevated position of the arch.

A force may be applied to the handle to overcome the force of the spring and rotate the handle in a second direction to a second stop position to position the cam surface in a second position having the cam surface of the latch assembly disengaged from the receiving surface of the lock pin and thereby unlock the first and second leg sections from one another so that one of the leg sections may be pivoted to provide the lowered position of the arch.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
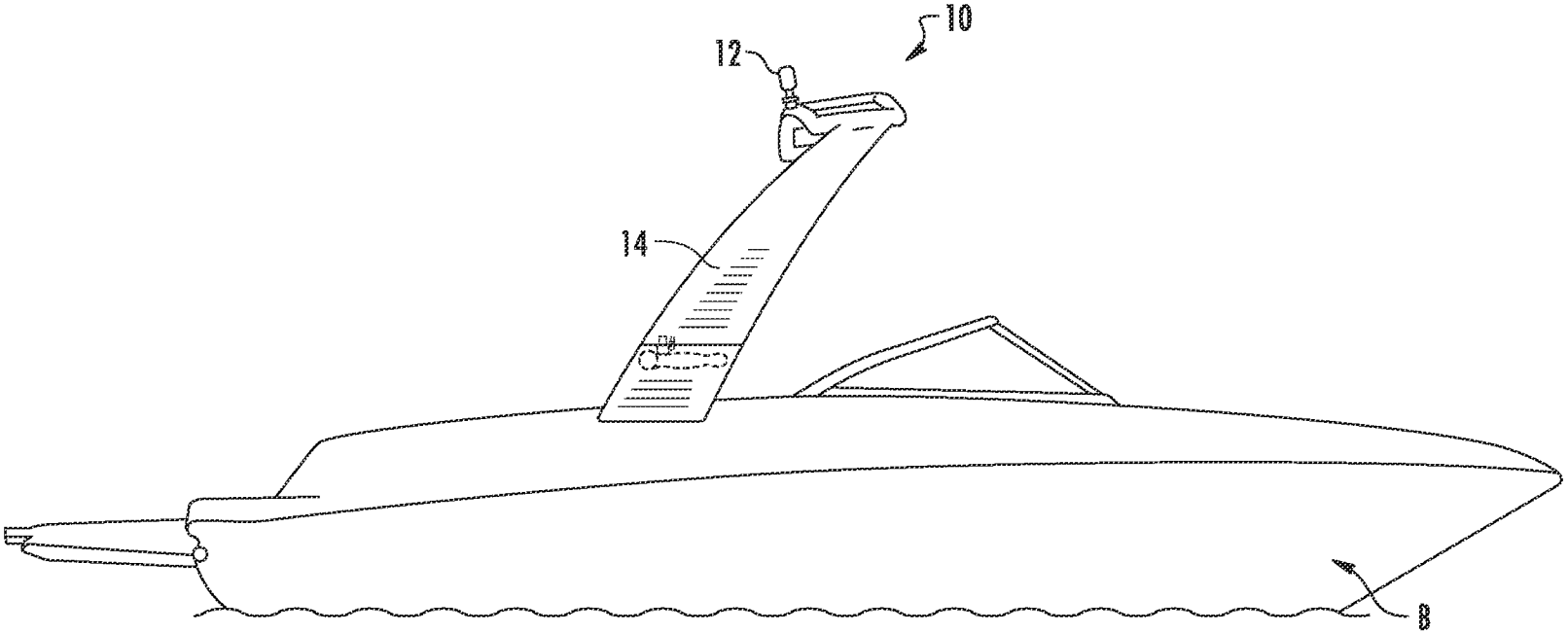
FIG. 1 shows a boat having a tower in an elevated orientation that includes folding legs and latch structures according to the disclosure.
Figure 2:
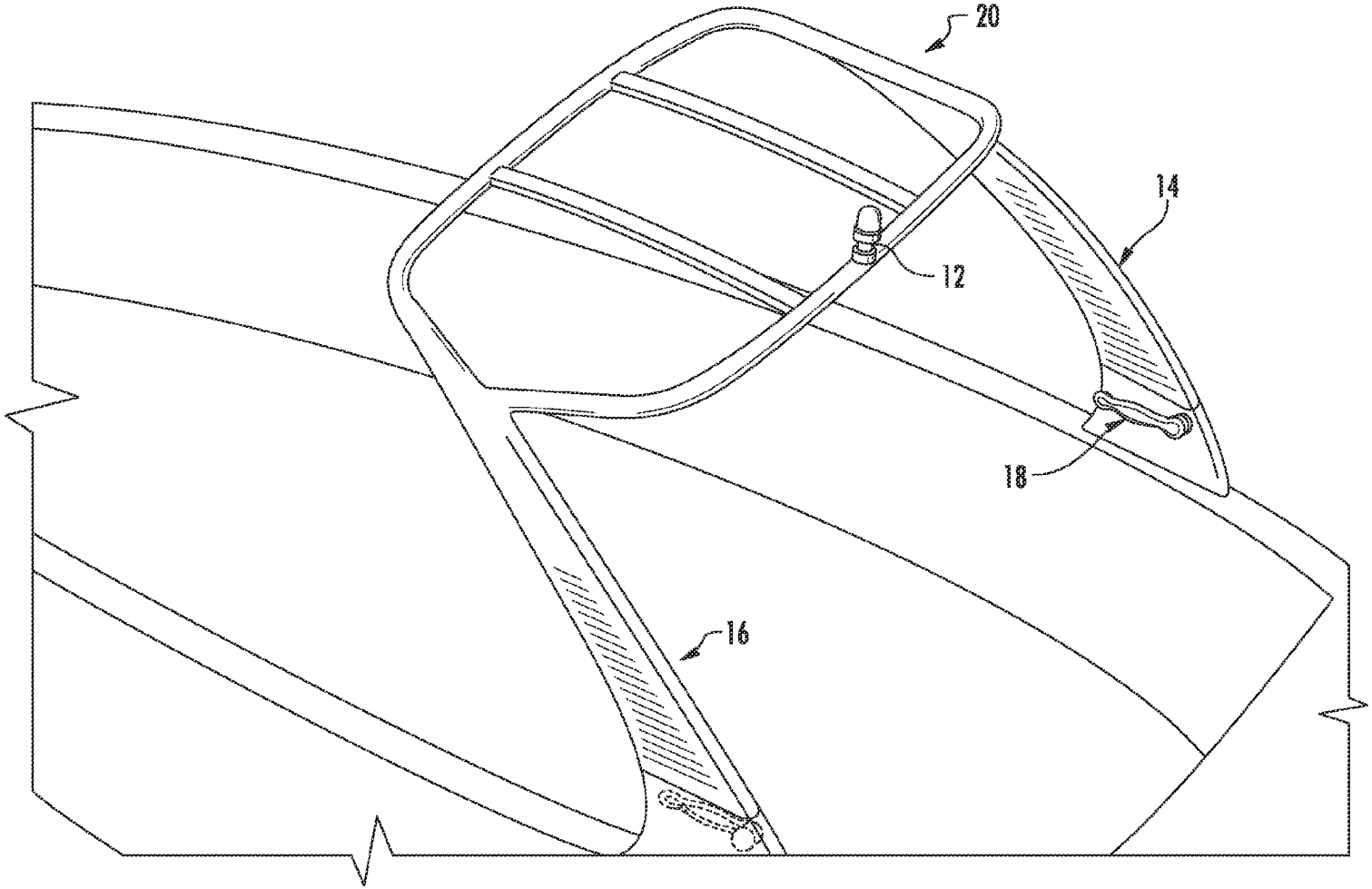
FIG. 2 is an enlarged view of a portion of the tower structure shown in FIG. 1.

With reference to FIGS. 1 and 2, there is shown a boat B having wakeboard tower 10 configured according to the disclosure to include an elevated location to provide a tow point 12, and foldable support legs 14 and 16 that enable the tower 10 to be folded to reduce the height of the tower 10. Each of the legs 14 and 16 is configured to include a latch system 18 operable to lock the legs to maintain the tower 10 in the elevated orientation, and to unlock the legs to enable the tower to be positioned in a lowered orientation.

It will be appreciated that various wakeboard tower accessories, such as speakers, racks, mirrors, and lights may be attached onto the tower 10, and the tower 10 may also include a cover.

Figure 3:
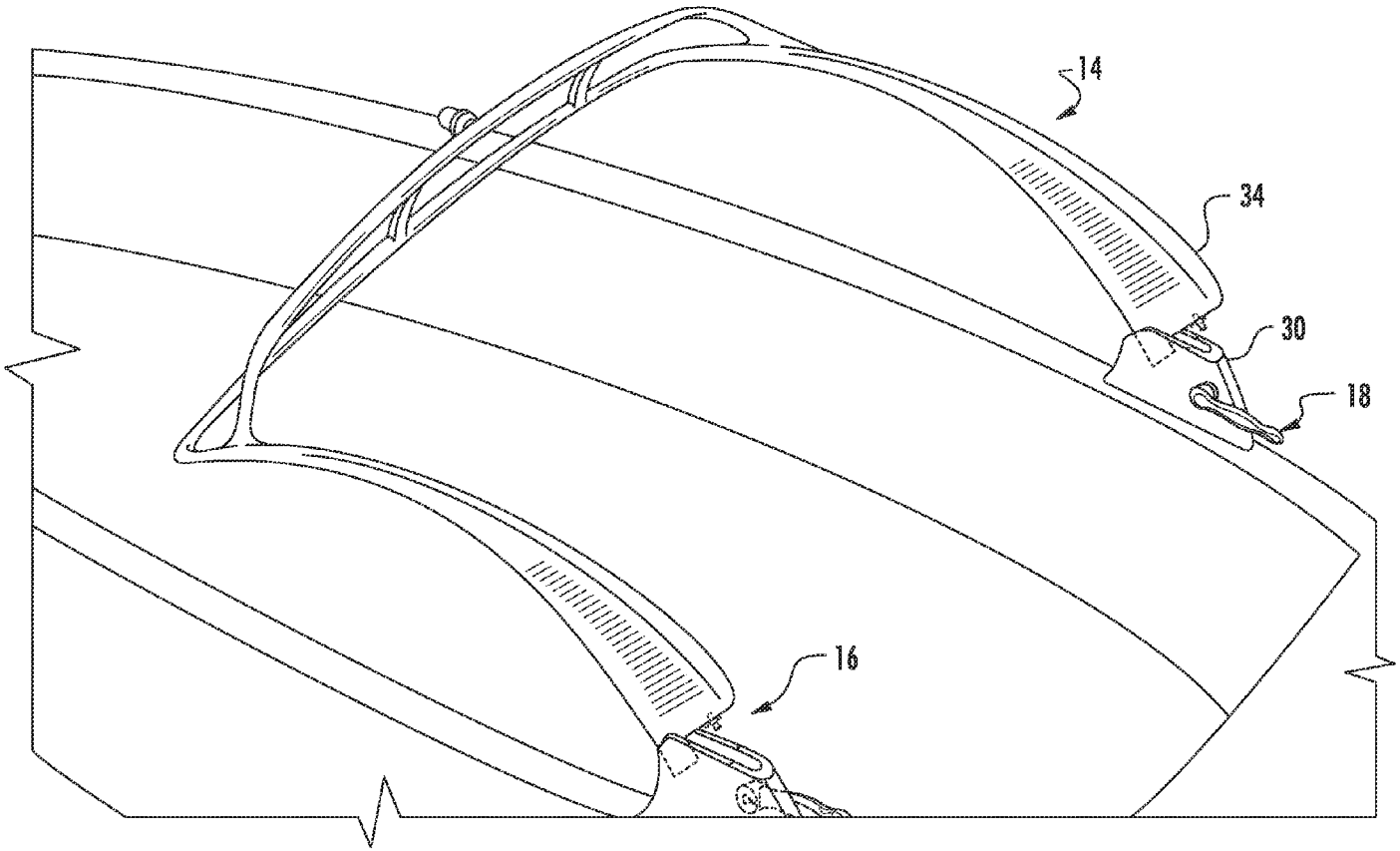
FIG. 3 shows the tower structure of FIG. 2 in a folded orientation.
Figure 4:
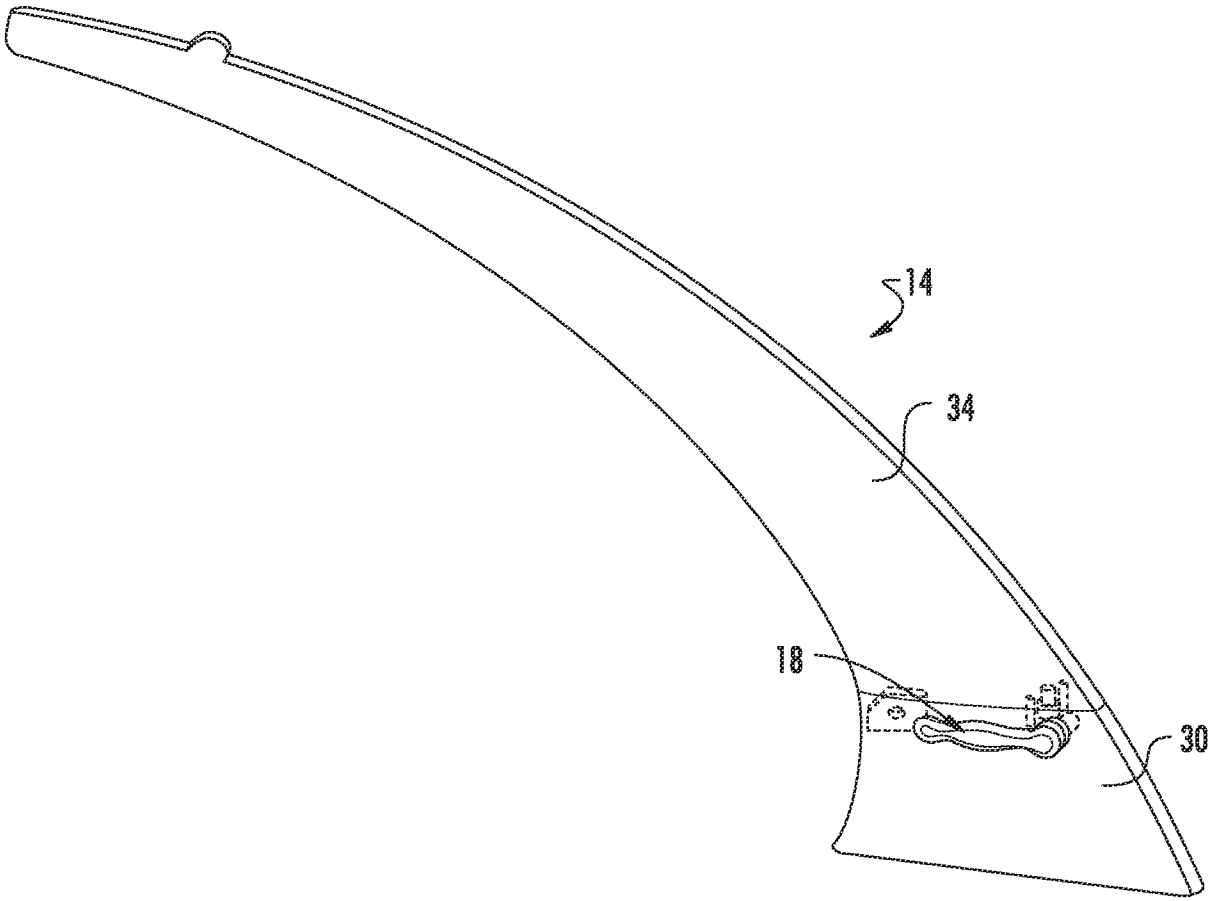
FIG. 4 is a side view of one of the folding legs of the tower structure of FIG. 1, with the leg latched in an unfolded or erect orientation.
Figure 5:
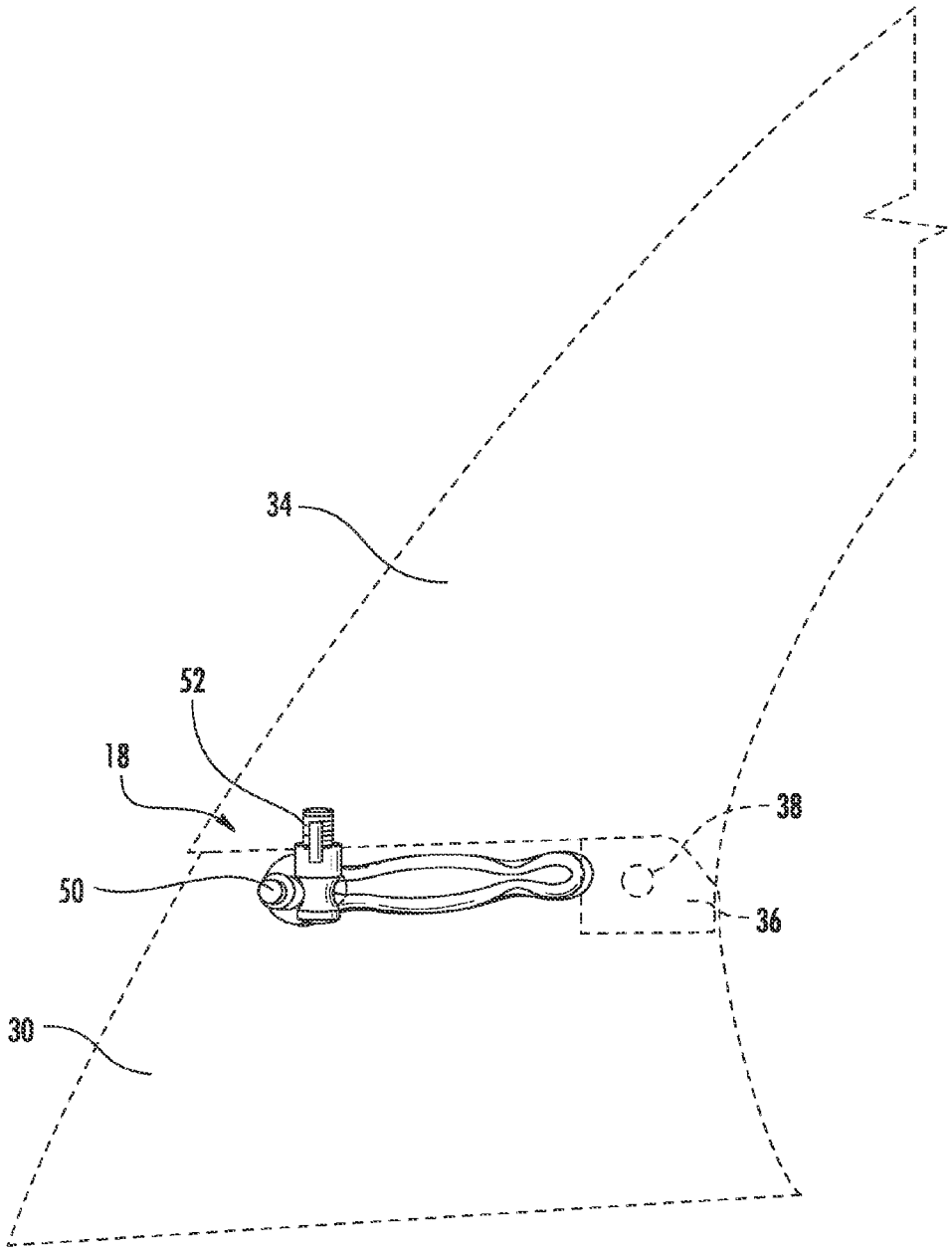
FIG. 5 is a close-up view of portion of the opposite side of the leg of FIG. 4.
Figure 6:
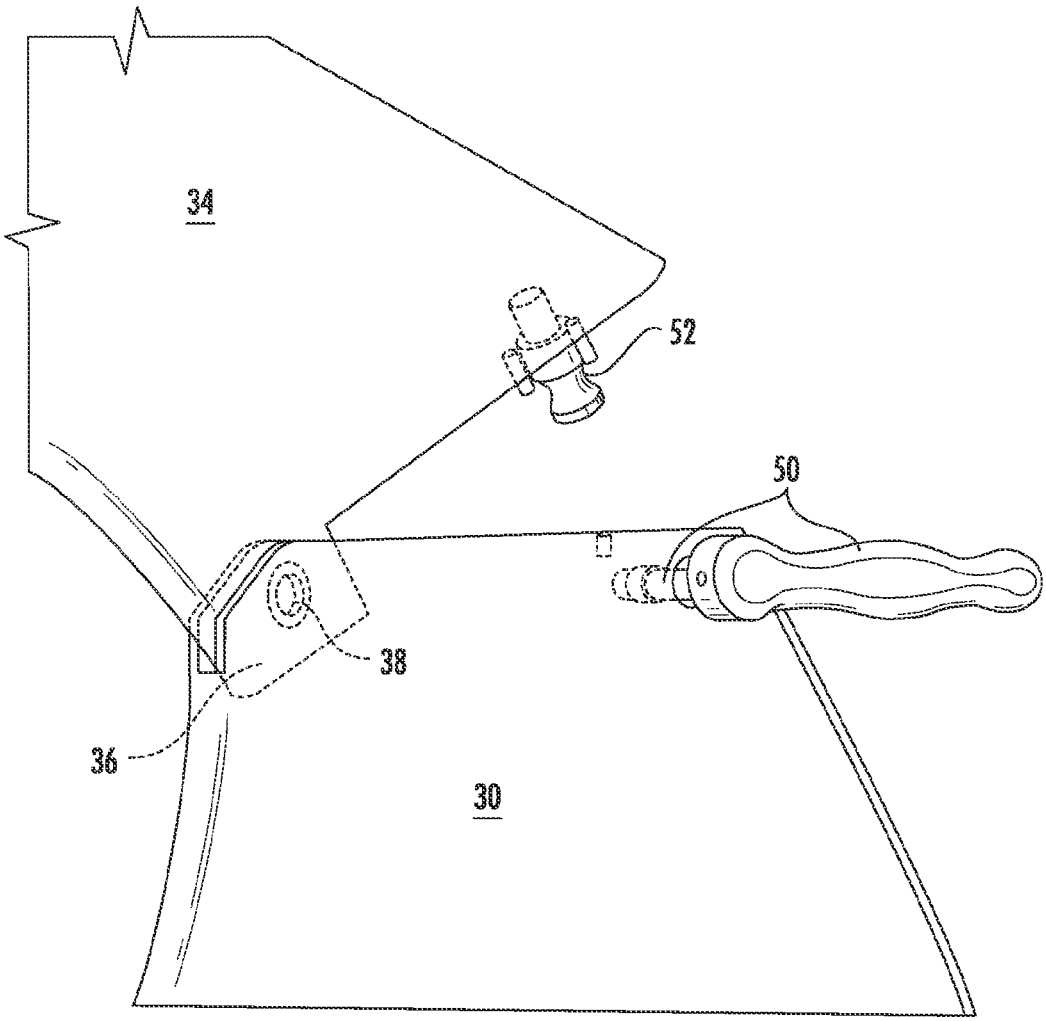
FIG. 6 is a side view showing the leg of FIG. 7 in an unlatched condition and pivoted toward a folded orientation.

FIGS. 1 and 2 show the tower 10 in a fully erected or elevated position. FIG. 3 shows the tower 10 in a folded or lowered position. The legs 14 and 16 are foldable to enable these tower configurations. The latch system 18 of each of the legs 14 and 16 is operable to selectively lock the legs in the elevated position, or to unlock the legs to permit them to be folded.

In addition to the legs 14 and 16, the tower 10 includes a crosspiece or lateral section 20 attached to and supported at each end by the legs 14 and 16. The tow point 12 is centrally located on the lateral section 20. The components of the tower 10 are typically made of aluminum and generally configured in the shape of an arch mountable to a boat so as to extend in a forward or bow direction, rising along its length.

Figure 7:
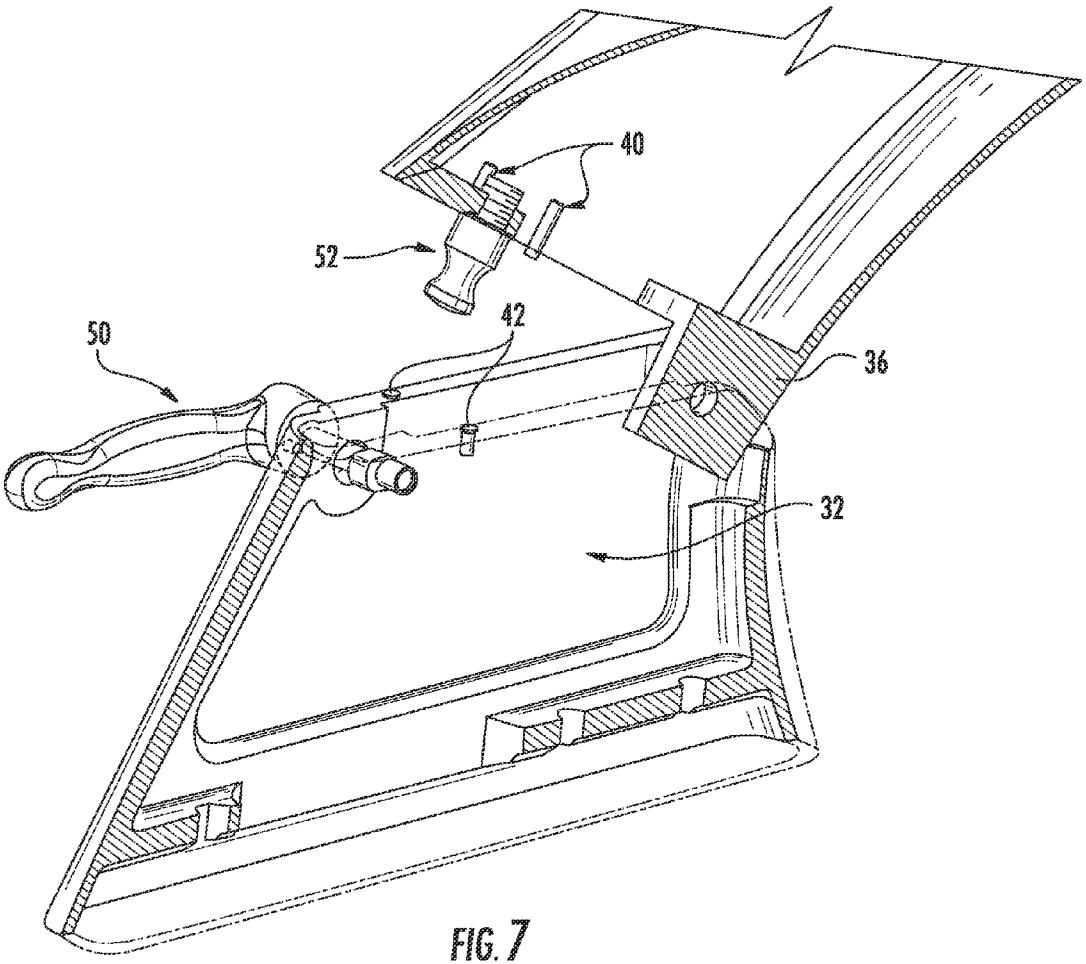
FIG. 7 is an opposite side view of the leg of FIG. 6 in the unlatched condition.
Figure 8:
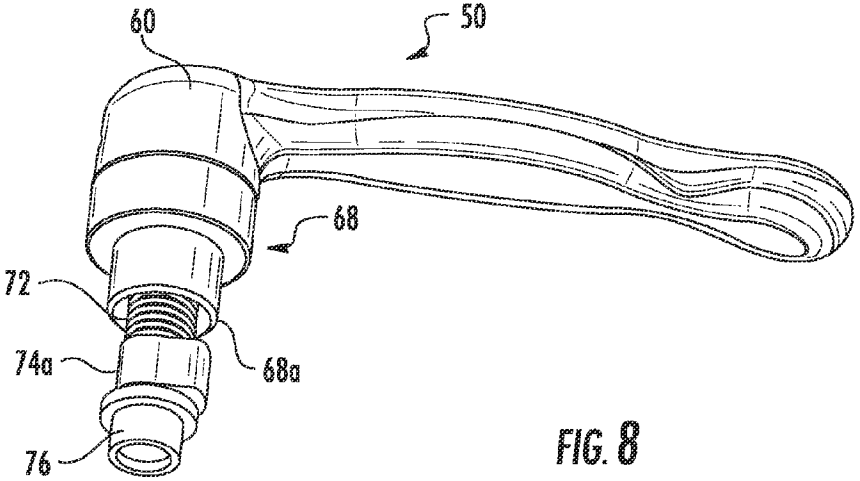
FIG. 8 is an assembled view of a latch assembly utilized with the tower structure of FIG. 1.
Figure 9:
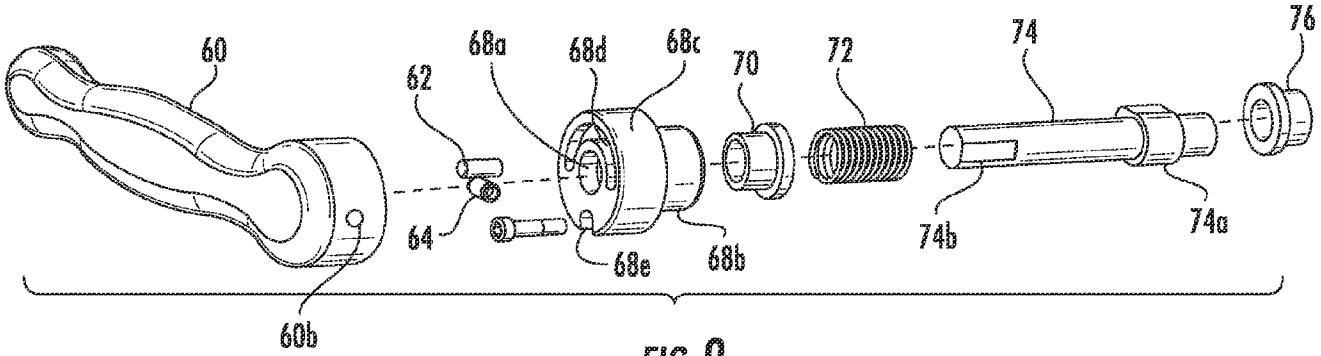
FIGS. 9 and 10 are exploded views of the latch assembly of FIG. 8.
Figure 10:
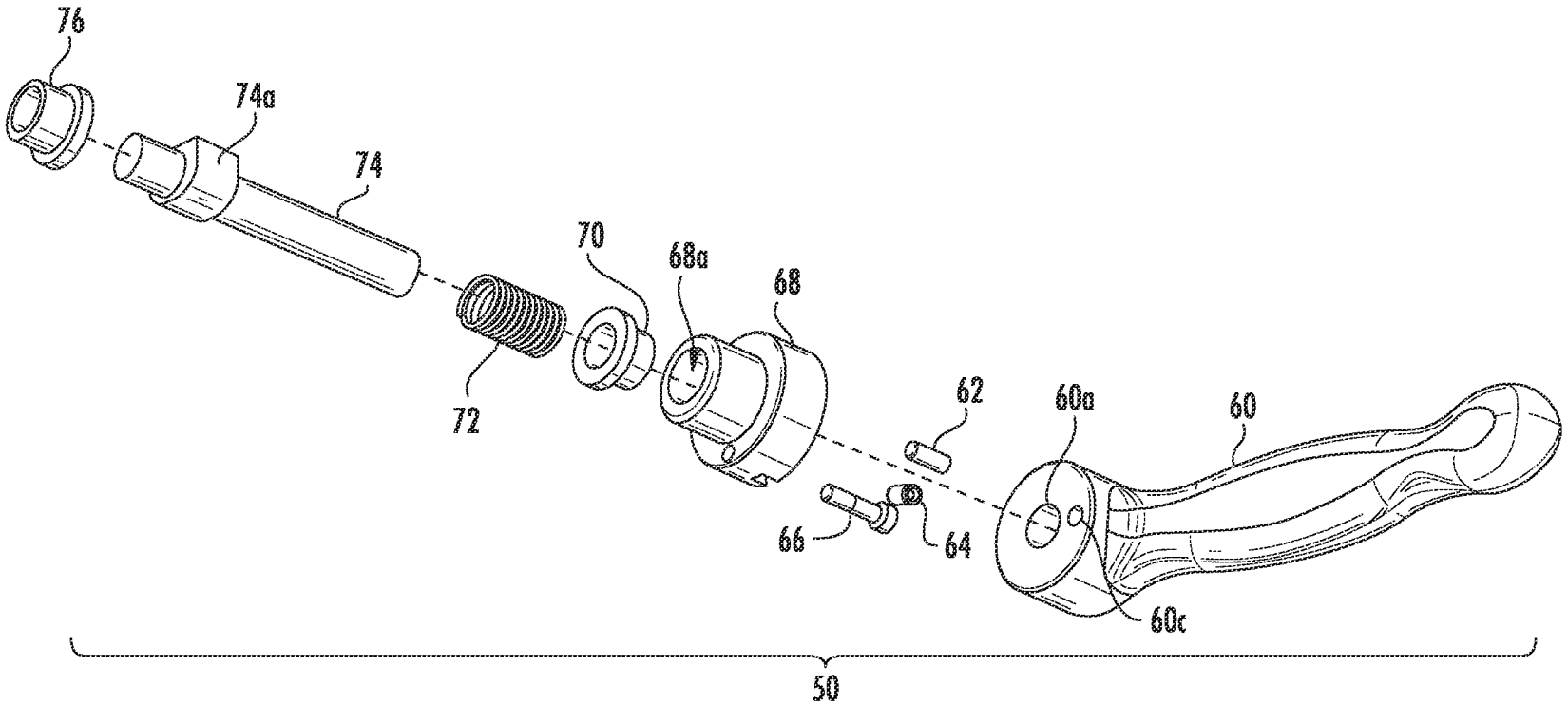
Figure 11:
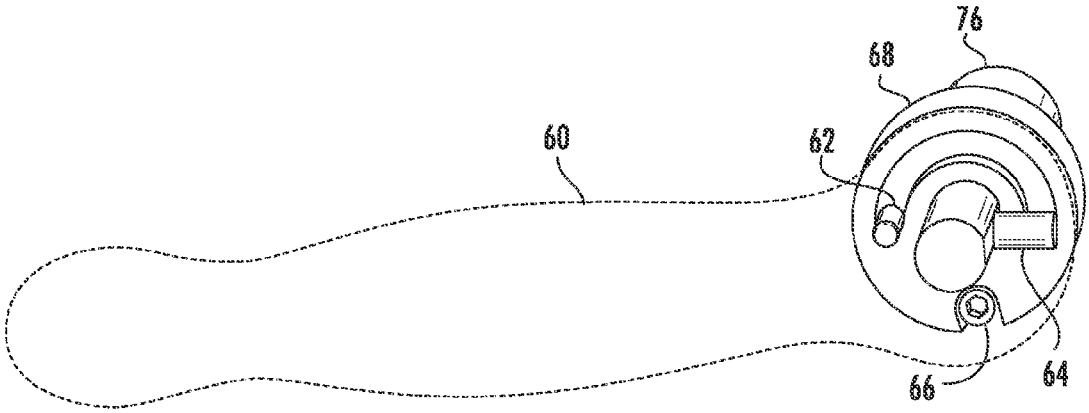
FIGS. 11 and 12 are assembled views of the latch assembly of FIG. 8, with portions thereof provided transparent to show details of the assemblage.
Figure 12:
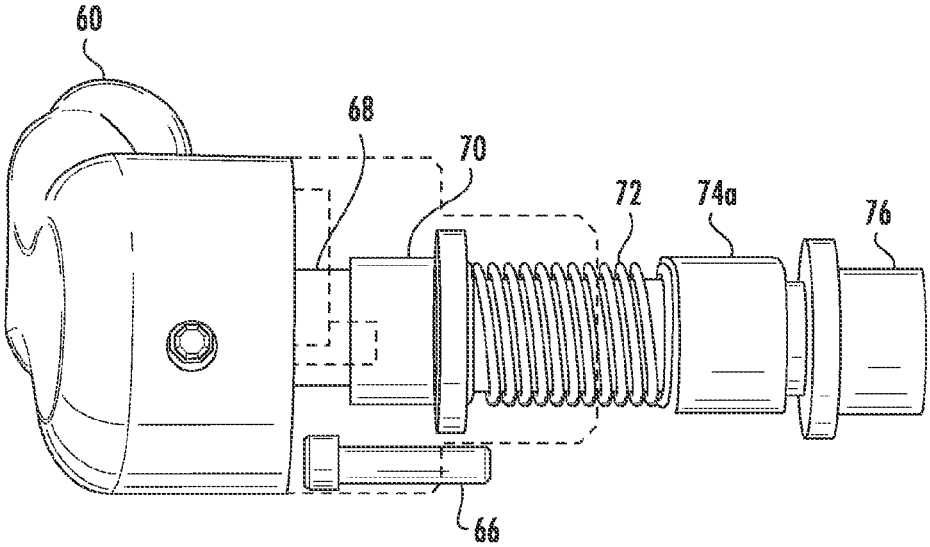

The legs 14 and 16 are substantially identical to one another, but one configured for locating on the port side of the boat and the other on the opposite starboard side of the boat. Accordingly, only the leg 14 is described in detail, it being understood that the leg 16 is substantially identical thereto. With additional reference to FIGS. 4-7, the leg 14 includes a base 30 that is fixedly mounted as by fasteners at its lower end to a portion of a B, such as the boat gunwales. The base 30 is generally hollow or otherwise configured to have an open upper end to define an interior cavity 32 (FIG. 7).

The leg 14 also includes an upper section 34 having a lower end seated onto the base 30 and pivotally connected to the base 30, and an upper end connected to the lateral section 20. To provide a pivotal connection between the lower end of the upper section 34 and the base 30, a lower leading end (relative to the front of the boat B) of the upper section 34 may be configured to provide an extension 36 configured to be located within the interior cavity 32 of the base 30. The extension 36 may be pivotally connected to the base 30 as by a circular or other receiver located interior of the base 30 and extending into aperture 38 of the extension 36, or by use of other pivotal or hinge structure to render the upper section 34 of the leg 14 so that it is pivotally movable relative to the base 30. The upper section 34 may include pins 40 oriented and aligned to seat into corresponding apertures 42 of the base 30 when the leg 14 is in the erected or elevated position with the upper section 34 seated onto the base 30. Engagement of the pins 40 within the apertures 42 is advantageous for stability of the leg 14 in the elevated position.

The latch system 18 includes a spring loaded latch assembly 50 mounted to the base 30 of the leg 14 and a lock pin 52 mounted to the upper section 34 of the leg 14. The latch assembly 50 is operable to selectively engage with or disengage from the lock pin 52. If desired, the locations of the latch assembly 50 and the lock pin 52 may be reversed, with the latch assembly 50 located on the upper section 34 of the leg 14 and the lock pin 52 located on the base 30.

Engagement of the latch assembly 50 with the lock pin 52 locks the upper section 34 of the leg 14 relative to the base 30 of the leg 14. In the locked configuration, the upper section 34 is locked to the base 30 and the tower 10 is locked in the elevated position shown in FIG. 2.

Disengagement of the latch assembly 50 from the lock pin 52 unlocks the upper section 34 of the leg 14 from the base 30 of the leg 14. In the unlocked configuration, the upper section 34 may be pivoted from the base 30 to enable the tower 10 to be oriented to the lowered position shown in FIG. 3.

With additional reference to FIGS. 8-12, the spring loaded latch assembly 50 includes a handle 60, guide pin 62, set screw 64, mounting fastener 66, mount 68 having a through bore 68*a*, proximal bearing 70, spring 72, latch rod 74 having a latch cam 74*a* and a slot 74*b*, and distal bearing 76.

As assembled, the latch assembly 50 is configured so that the handle 60 is located exterior to the base 30 and the latch rod 74 is located in the cavity 32 of the base 30. In this regard, the mount 68 has a smaller dimensioned distal end 68*b* that extends through a corresponding sidewall aperture of the base 30 and a larger dimensioned proximal end 68*c* that remains exterior of the base 30.

The distal bearing 76 is mounted on the distal end of the latch rod 74 and engages a cooperating receiver of the base 30. The spring 72 slides over the proximal end of the latch rod 74 and is located adjacent the latch cam 74*a*. The proximal bearing 70 is slidingly located over the proximal end of the latch rod 74 so that the spring 72 is between the latch cam 74*a* and the proximal bearing 70.

The latch cam 74*a* is fixedly formed or mounted on the latch rod 74. The slot 74*b* of the latch rod 74 extends completely through the bore 68*a* of the mount 68 and is received within a handle bore 60*a* of the handle 60. The set screw 64 is threaded through a threaded aperture 60*b* of the handle 60 to engage the slot 74*b* of the latch rod 74 to fix the handle 60 to the latch rod 74 so that rotation of the handle 60 will result in rotation of the latch rod 74 and the latch cam 74*a*. With the handle 60 assembled to the latch rod 74, one end of the guide pin 62 fits into an aperture 60*c* of the handle 60 and the other end of the guide pin 62 extends into a semi-circular guide slot 68*d* located on the mount 68. The mounting fastener 66 extends through a mounting aperture 68*e* of the proximal end 68*c* of the mount 68 to mount the latch assembly 50 to the base 30. As mounted, the handle 60 may be rotated about half a revolution as limited by the guide slot 68*d* and the guide pin 62, which results in engagement or disengagement of the latch cam 74*a* with the lock pin 52, as described in more detail below.

Figure 13:
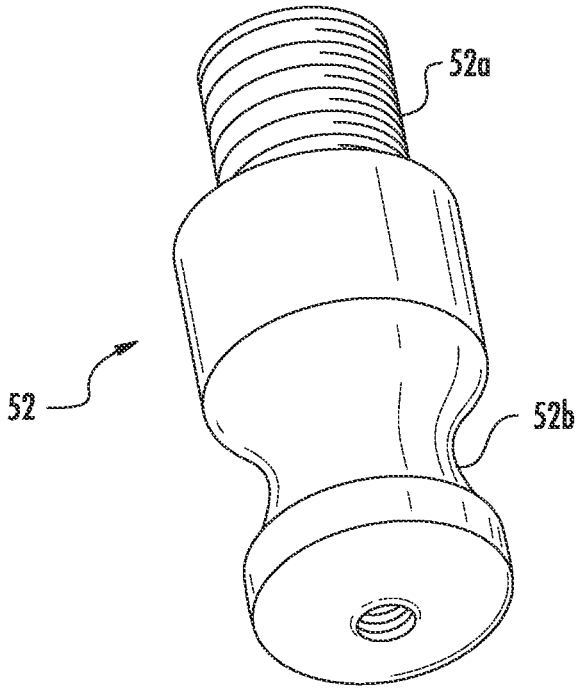
FIGS. 13 and 14 show a lock pin utilized with the latch assembly of FIG. 8 to provide the tower structure of FIG. 1
Figure 14:
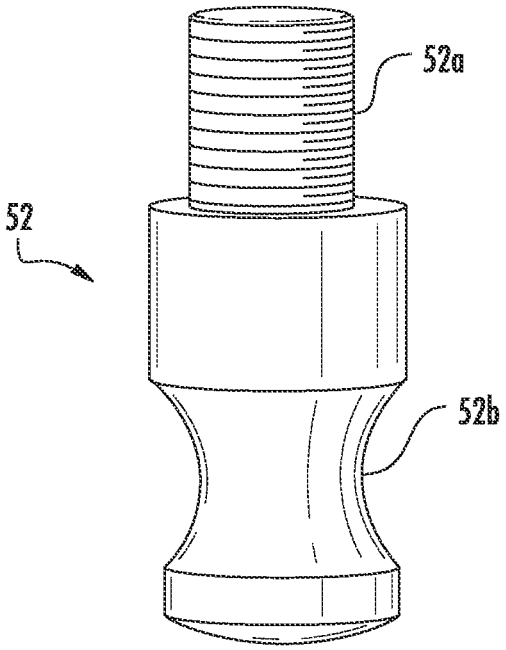

With additional reference to FIGS. 13 and 14, the lock pin 52 includes an upper mount portion 52*a* and a lower engagement portion 52*b*. The mount portion 52*a* is configured to mount to a lower surface of the upper section 34 of the leg 14. For example, the upper section 34 may have a threaded aperture and the mount portion 52*a* may be threaded to be threaded into the threaded aperture of the upper section.

Figure 15:
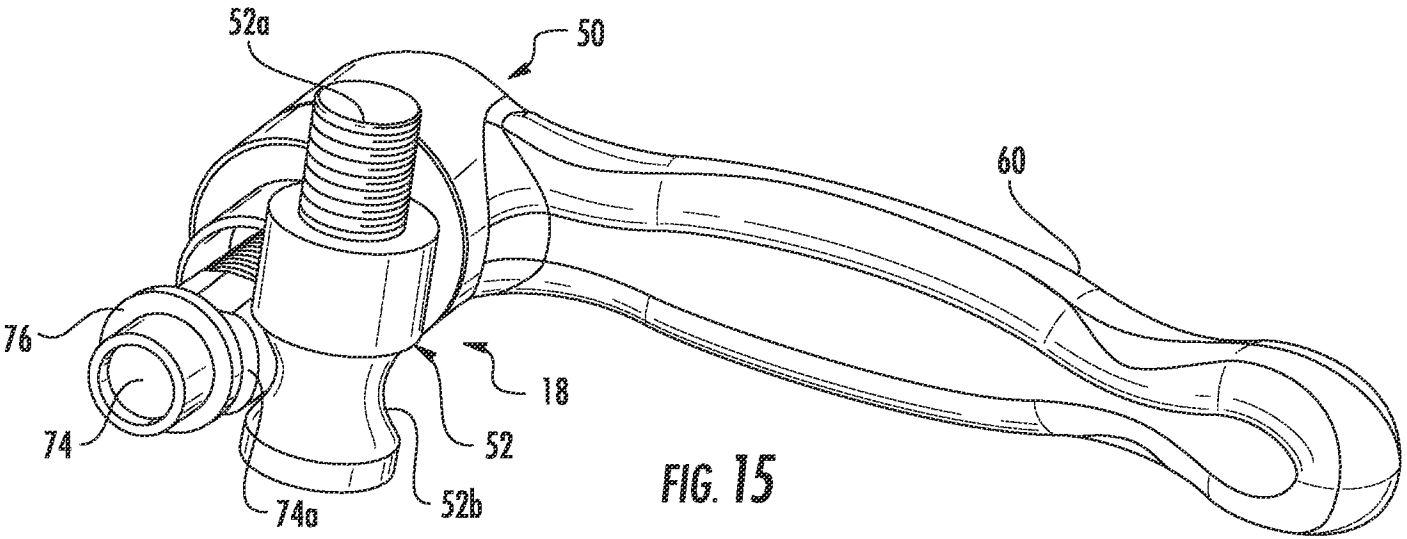
FIG. 15 shows the latch assembly oriented to engage with the lock pin.
Figure 16:
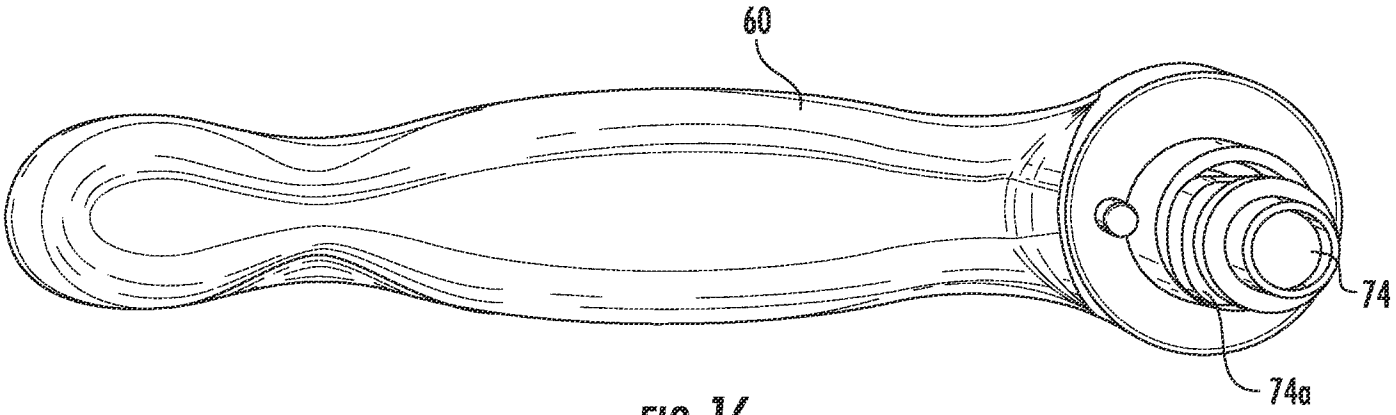
FIG. 16 shows the latch assembly in the same orientation as in FIG. 15, but without the lock pin.
Figure 17:
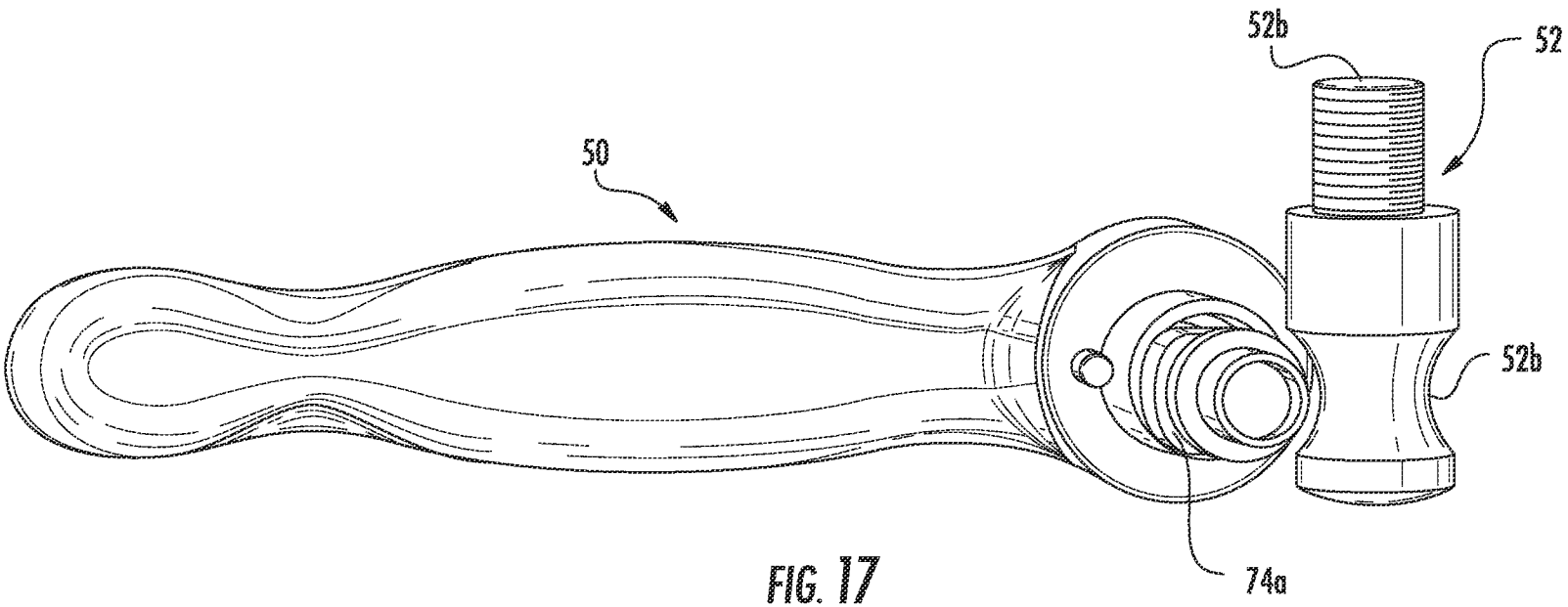
FIG. 17 shows the latch assembly oriented to disengage from the lock pin.

With further reference to FIGS. 15-17, the lower engagement portion 52*b* and the latch cam 74*a* are mutually configured so that rotation of the latch rod 74 results in selective engagement and disengagement of the latch cam 74*a* with the engagement portion 52*b*. FIG. 15 shows the latch cam 74*a* rotated into engagement with the engagement portion 52*b*. FIGS. 16 and 17 show the latch cam 74*a* rotated so as to be oriented to be disengaged from the engagement portion 52*b* of the lock pin 52.

The latch cam 74*a* may be provided as a smooth sided and rounded rectangle, and the engagement portion 52*b* configured as a rounded concavity. The rounded surfaces permit a smooth transition so that the latch cam 74*a* can be rotated by the handle 60 into engagement with and disengagement from the engagement portion 52*b*. In this regard, it will be understood that the spring 72 of the latch assembly 50 serves to supply a pressure or resistance to maintain the latch cam 74*a* within the engagement portion 52*b*. The rounded shapes facilitate disengagement of the latch cam 74*a* from the engagement portion 52*b* when sufficient pressure is applied to the handle 60 to overcome the spring pressure and rotate the latch rod 74, and hence the latch cam 74*a* away from the engagement portion 52*b* of the lock pin 52. Engagement of the latch cam 74*a* with the engagement portion 52*b* results in an engagement sufficient to maintain the latch cam 74*a* in contact with the engagement portion 52*b* so that the upper section 34 of the leg 14 is locked relative to the base 30 of the leg 14, and the tower 10 is locked in the elevated position shown in FIG. 2.

As will be appreciated, the folding leg and latch structures described enable convenient locking and unlocking of the legs without the use of tools and without removable pins and the like that are often difficult to remove and are often lost.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated.

What is claimed:

1. A foldable boat tower mountable to a boat, the tower comprising:

an arch foldable between an elevated position and a lowered position, the arch having a crosspiece and a leg depending from the crosspiece, the leg having a base mountable to a boat and an upper section having a lower end seated onto the base and pivotally connected to the base; and a spring loaded latch assembly mounted to the base of the leg and a lock pin mounted to the upper section of the leg, the spring loaded latch assembly comprising a handle rotatably mounted to an exterior portion of the base and having a rod that extends into an interior cavity of the base, the rod including a protruding cam surface located on the rod for location within the cavity of the base and a spring operable to bias the cam surface in a direction away from the handle, and the lock pin including a receiving surface configured to fittingly receive the protruding cam surface, wherein when the upper section of the leg is seated onto the base of the leg, the lock pin is positioned within the cavity of the base adjacent to the cam surface of the spring loaded latch, and the handle may be rotated in a first direction to a first stop position to position the cam surface in a first position having the cam surface of the latch assembly engaged with the receiving surface of the lock pin and the spring supplies a force to maintain the cam surface within the receiving surface and thereby maintain the upper section of the leg seated onto the base of the leg to provide the elevated position of the arch, and wherein a force may be applied to the handle to overcome the force of the spring and rotate the handle in a second direction to a second stop position to position the cam surface in a second position having the cam surface of the latch assembly disengaged from the receiving surface of the lock pin so that the upper section of the leg may be unseated from the base and the arch folded to the lowered position of the arch.

2. The foldable boat tower of claim 1, wherein the receiving surface of the lock pin is concave.

3. The foldable boat tower of claim 1, wherein the spring loaded latch assembly includes a mount fixedly attached to the base of the leg, the base including a guide slot, and the handle includes a guide pin that extends into the guide slot, wherein rotation of the handle is limited by the guide slot and the guide pin.

4. A foldable boat tower mountable to a boat, the tower comprising:

an arch foldable between an elevated position and a lowered position, the arch having a crosspiece and a leg depending from the crosspiece, the leg having a first and second sections, one of the first and the second sections being pivotally positionable relative to the other between an elevated position and a lowered position; and a spring loaded latch assembly mounted to the first section of the leg and a lock pin mounted to the second section of the leg, the spring loaded latch assembly comprising a handle rotatably mounted to an exterior portion of the first section of the leg and having a rod including a protruding cam surface located on the rod and a spring operable to bias the cam surface in a direction away from the handle, and the lock pin including a receiving surface configured to fittingly receive the protruding cam surface, wherein the handle may be rotated in a first direction to a first stop position to position the cam surface in a first position having the cam surface of the latch assembly engaged with the receiving surface of the lock pin and the spring supplies a force to maintain the cam surface within the receiving surface and thereby lock the first and second leg sections together to provide the elevated position of the arch, and wherein a force may be applied to the handle to overcome the force of the spring and rotate the handle in a second direction to a second stop position to position the cam surface in a second position having the cam surface of the latch assembly disengaged from the receiving surface of the lock pin and thereby unlock the first and second leg sections from one another so that one of the leg sections may be pivoted to provide the lowered position of the arch.

5. The foldable boat tower of claim 4, wherein the first section of the leg comprises a base fixedly mounted to the boat and the second section of the leg is pivotally positionable relative to the first section of the leg.

6. A foldable elevated structure mountable to a boat, the elevated structure comprising:

an arch foldable between an elevated position and a lowered position, the arch having a crosspiece and a leg depending from the crosspiece, the leg having a first and second sections, one of the first and the second sections being pivotally positionable relative to the other between an elevated position and a lowered position; and a latch assembly mounted to the first section of the leg and a lock member mounted to the second section of the leg, the latch assembly comprising a handle rotatably mounted to an exterior portion of the first section of the leg and having a rotating cam surface attached thereto, and the lock member including a receiving surface configured to fittingly receive the rotating cam surface, wherein the handle may be rotated in a first direction to a first stop position to position the cam surface in a first position having the cam surface of the latch assembly engaged with the receiving surface of the lock member to thereby lock the first and second leg sections together to provide the elevated position of the arch, and wherein the handle may be rotated in a second direction to a second stop position to position the cam surface in a second position having the cam surface of the latch assembly disengaged from the receiving surface of the lock member to thereby unlock the first and second leg sections from one another so that one of the leg sections may be pivoted to provide the lowered position of the arch.

* * * * *